US006450175B1

(12) United States Patent
Park

(10) Patent No.: US 6,450,175 B1
(45) Date of Patent: Sep. 17, 2002

(54) NAIL CARE INSTRUMENT

(75) Inventor: Il-Yong Park, Seoul (KR)

(73) Assignee: Shinwoo Union Co., Ltd., Seoul (KR)

( * ) Notice: Subject to any disclaimer, the term of this patent is extended or adjusted under 35 U.S.C. 154(b) by 0 days.

(21) Appl. No.: 09/922,792

(22) Filed: Aug. 7, 2001

(30) Foreign Application Priority Data

May 9, 2001 (KR) ..... 2001-0013448 U

(51) Int. Cl.[7] ..... A45D 29/18
(52) U.S. Cl. ..... 132/76.4; 132/75.6; 132/73.5
(58) Field of Search ..... 132/76.4, 75.6, 132/73; 451/494, 523

(56) References Cited

U.S. PATENT DOCUMENTS 3,809,101 A * 5/1974 Shimizu ..... 132/76.4
4,047,902 A * 9/1977 Wiand ..... 51/295
4,397,325 A * 8/1983 Van Roeyen ..... 132/76.4
5,357,717 A * 10/1994 Friel et al. ..... 451/494

* cited by examiner

*Primary Examiner*—John J. Wilson
*Assistant Examiner*—Robyn Kieu Doan
(74) *Attorney, Agent, or Firm*—Greenblum & Bernstein, P.L.C.

(57) ABSTRACT

A nail care instrument has abrasive portions formed by an electroplating process. The instrument comprises a base of synthetic resin, a copper film coated on one surface of the base and having a plurality of release recesses formed by corroding selected portions of the copper film. The abrasive portions formed on non-corroded portions of the copper film, wherein the abrasive portions are formed by electroplating an abrasive substance on the non-corroded portions of the copper film in a solution containing white alumina or the abrasive powder.

2 Claims, 2 Drawing Sheets

NAIL CARE INSTRUMENT

BACKGROUND OF THE INVENTION

1. Field of the Invention

The present invention relates to a nail care instrument, and more particularly, to a nail care instrument having abrasive (i.e., file tooth portions formed by an electroplating process.

2. Background of the Related Art

A conventional nail care instrument includes a grinding surface which has peaks and valleys formed by mechanically processing a metal surface, micro protrusions formed by a chemical corrosion process, or a grinding surface adhered on a base using an adhesive.

However, the conventional nail care instruments have the following problems, i.e., since foreign fine substances generated after the use of such instruments are filled in the valleys of the abrasive or the grinding surface, blade becomes blunt, or since the abrasive is separated from the grinding surface, the grinding effect is substantially reduced. Also, another technique has been proposed, in which thru-holes are formed on the grinding surface to allow the filled foreign substance to be released from the grinding surface.

However, this technique also has a disadvantage in that, since the number of holes and the spacing between the holes are limited in order to provide enough strength to prevent the instrument from being bent when using the instrument and whereby release amount of the foreign fine particles is limited, it is difficult to smoothly file the nail.

SUMMARY OF THE INVENTION

Accordingly, the present invention is directed to a nail care instrument that substantially obviates one or more problems due to limitations and disadvantages of the related art.

An object of the present invention is to provide a nail care instrument, in which filed foreign substance is effectively released from a file tooth portion.

Another object of the present invention is to provide a nail care instrument of which the durability is remarkably increased by varying a method of adhering the abrasive.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve the object and other advantages and in accordance with the purpose of the invention, as embodied and broadly described herein, a nail care instrument comprises: a base of synthetic resin; a copper film coated on one surface of the base and having a plurality of release recesses formed in a regular form by corroding selected portions of the copper film; and abrasive portions formed on non-corroded portions of the copper film, wherein the abrasive portions are formed by electroplating an abrasive substance on the non-corroded portions of the copper film, the abrasive substance being made by mixing an abrasive powder with a plating solution and stirring the mixture, the abrasive powder being white alumina, and a region of the release recesses is sufficiently allocated to cross over the abrasive portions.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Figure 1:
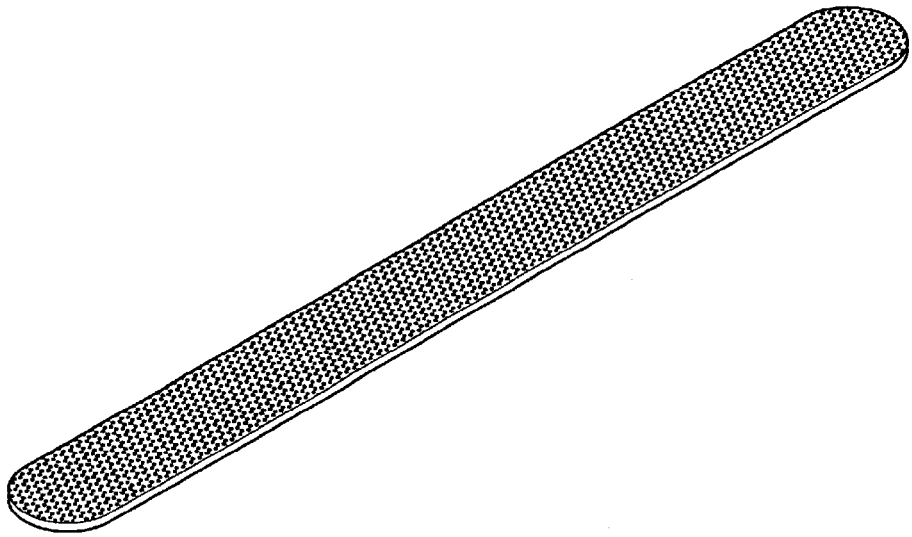
FIG. 1 is a perspective view of a nail care instrument according to the present invention.

Reference will now be made in detail to the preferred embodiment of the present invention, examples of which are illustrated in the accompanying drawings.

As shown in the accompanying drawings, a nail care instrument of the present invention comprises a base 6 of synthetic resin; a copper film 3 coated on one surface of the base and having a plurality of release recesses 2 formed in a regular form by corroding selected portions of the copper film; and abrasive portions 1 formed on non-corroded portions of the copper film 3, wherein the abrasive portions are formed by electroplating abrasive substance of white alumina on the non-corroded portions of the copper film 3, the abrasive substance being made by mixing an abrasive powder with a plating solution and stirring the mixture, the abrasive powder being white alumina, and a region of the release recesses 2 being sufficiently allocated to cross over the abrasive portions 1.

When grinding a nail with the nail care instrument according to the present invention, the grinding is performed by the abrasive portions 1, and filed substances are gathered in the release recesses 2 and released therefrom.

A manufacturing process of the abrasive portions 1 and release recesses 2 will now be explained in detail.

A forming process of the release recesses 2 is similar to a typical etching procedure for manufacturing an electric circuit board.

First, a mask film having a variety of patterns corresponding to the release recesses of the copper film coated on the nail care instrument is manufactured. Photoresist solution is then coated on the copper film 3 formed on one surface of the base 6 made of synthetic resin. After that, the mask film is positioned on the photoresist solution and the photoresist solution is then exposed to a light. The exposed photoresist solution portions are hardened. Non-exposed portions are removed by cleaning them with water and thus photoresist pattern is formed on the copper film. Afterwards, the resultant base is dipped in a corrosive solution and thus the exposed portions of the copper film portions are removed by the corrosive solution, thereby forming a number of release recesses 2 having the designed pattern.

The plurality of release recesses 2 can have various shapes such as a circle, a hexagon, a band or the like. These shapes are manufactured in such a manner that the abrasive portions 1 except for the release recesses 2 are electrically connected to each other through lines, so that an electric current flows through the abrasive portions 1 in course of the electroplating as described below.

Next, a forming process of the abrasive portions 1 will now be explained. After the hardened photoresist solution portions existing on the copper film 3 are removed using an alkaline solution such as caustic soda, and then the copper film 3 connected to the cathode is immersed into a nickel plating solution which is mixed with white alumina particles 5. When the nickel and alumina particles are electroplated on the copper film, the nickel is plated on the surface of the copper film 3 to form a nickel film 4 while the white alumina particles 5 are rigidly attached to the surface of the nickel film 4.

Figure 2:
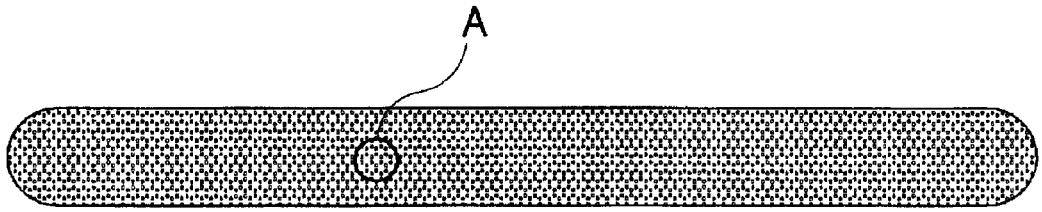
FIG. 2 is a top plan view of a nail care instrument according to the present invention.
Figure 3:
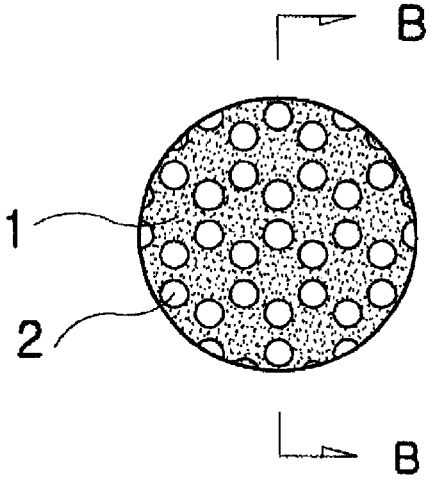
FIG. 3 is an enlarged top plan view of a circle portion indicated by the letter "A" in FIG. 2.

FIG. 3 is an enlarged top plan view of a circle indicated by the letter "A" of FIG. 2, and shows a portion of the nail care instrument according to the present invention. Each of the release recesses 2 has a circular shape, and six release recesses 2 are arranged in a hexagonal shape. Such arrangement is mere one example of the present invention.

Figure 4:
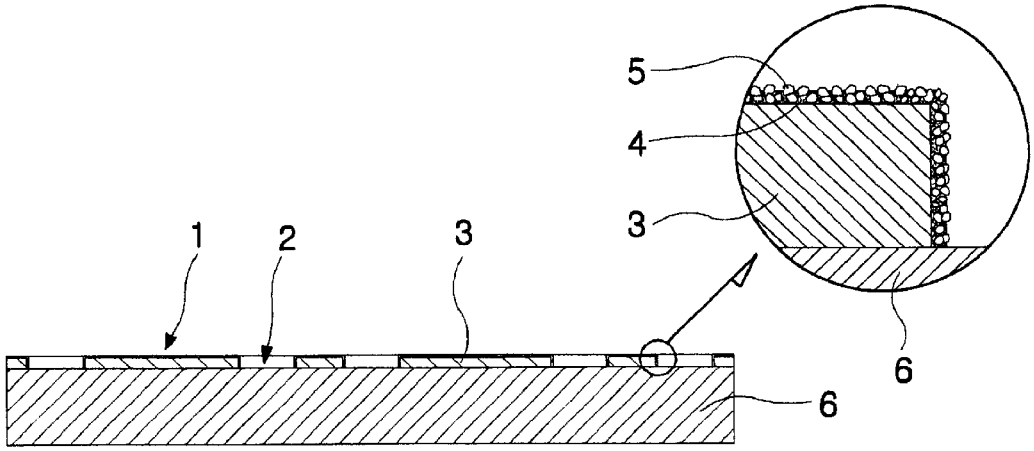
FIG. 4 is a cross-sectional view taken along a line B—B in FIG. 3.

Referring to FIG. 4, the release recesses 2 is formed on selected portions of the copper film 3 by corroding the copper film 3, while the white alumina particles 5 are attached to the remaining portion of the copper film 3 by the electroplating to form the abrasive portions 1. FIG. 4 illustrates the surface of the abrasive portions 1, in which the alumina particles 5 are uniformly adhered on a nickel film 4 plated on the surface.

Figure 5:
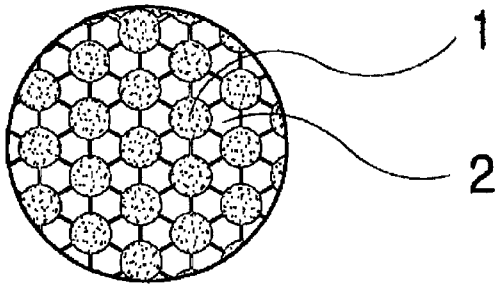
FIG. 5 is a view illustrating another embodiment of a nail care instrument according to the present invention.

FIG. 5 is a view illustrating another embodiment of a nail care instrument according to the present invention, in which the pattern of the abrasive portions formed on one surface of the nail care instrument is shown. Each of the abrasive portions 1 has a circular shape and the abrasive portions are electrically connected to each other. The remaining portion of the nail care instrument except for the release grooves 2 is formed with the abrasive portions 1. In order to maximize the release of the filed substance (filed powder of the nail), the region of the release recesses is sufficiently allocated to cross over the abrasive portions in a proper width and spacing, thereby increasing the filing effect. Since the base 6 functions substantially as a supporting member, even though the nail care instrument is provided with enough abrasive portions and release recesses, the base can be prevented from being bent.

Although the pattern shown in FIG. 5 is merely one example of the present invention, patterns having other shapes may be formed by changing the arrangement of the release recesses and the abrasive portions.

According to the construction, the nail is ground by the abrasive portions 1 with the white alumina particles 5 adhered thereto, and the ground substance is easily released from the release recesses 2. In addition, since the filed substance does not lodge in the release recesses, this is a sanitary nail care instrument of the present invention, relative to the conventional arts in which the abrasive portions are formed on the entire surface or the instrument has a number of thru-holes.

Moreover, since the abrasive substance is rigidly attached by using the electroplating, the durability thereof is extended.

Various patterns of the abrasive portions and release recesses can be provided through the electroplating.

The forgoing embodiment is merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A nail care instrument comprising:

a base of synthetic resin;

a copper film coated on one surface of the base and having a plurality of release recesses formed in a regular form by corroding selected portions of the copper film; and abrasive portions formed on non-corroded portions of the copper film, wherein the abrasive portions are formed by electroplating abrasive substance on the non-corroded portions of the copper film, the abrasive substance comprising a white alumina abrasive powder mixed with a plating solution and a region of the release recesses is allocated to cross over the abrasive portions.

2. The instrument as claimed in claim 1, wherein the copper film having the release recesses and the abrasive portions are formed on both surfaces of the base.

* * * * *